United States Patent [19]

Feurer-Zogel et al.

[11] Patent Number: 4,573,279

[45] Date of Patent: Mar. 4, 1986

[54] RUNNING SOLE FOR SHOES, ESPECIALLY SPORTS SHOES, WITH ADJUSTABLE HEEL CUSHIONING

[75] Inventors: Rudolf Feurer-Zogel, Fürth; Rudolf Vogler, Herzogenaurach, both of Fed. Rep. of Germany

[73] Assignee: Adidas Sportschuhfabriken Adi Dassler Stiftung & Co. KG, Fed. Rep. of Germany

[21] Appl. No.: 667,351

[22] Filed: Nov. 1, 1984

[30] Foreign Application Priority Data

Dec. 9, 1983 [DE] Fed. Rep. of Germany ..... 3344535
Aug. 22, 1984 [DE] Fed. Rep. of Germany ..... 3430845

[51] Int. Cl.[4] ..... A43B 21/26

[52] U.S. Cl. ..... 36/35 R; 36/36 R; 36/36 A

[58] Field of Search ..... 36/35 R, 36 R, 36 A, 36/36 B, 37, 35 A, 35 B

[56] References Cited

U.S. PATENT DOCUMENTS 868,054 10/1907 Witkowski ..... 36/36 A
1,283,468 11/1918 Clarke ..... 36/36 B
1,359,626 11/1920 Sohr ..... 36/36 A
1,993,425 3/1935 Werkman ..... 36/36 A
3,318,025 5/1967 Antelo ..... 36/36 B

FOREIGN PATENT DOCUMENTS 2448308 10/1980 France ..... 36/35 R
204758 of 1963 Sweden ..... 36/36
16966 of 1907 United Kingdom ..... 36/36 A
14308 of 1909 United Kingdom ..... 36/36 A
705567 3/1954 United Kingdom ..... 36/35 A

*Primary Examiner*—Werner H. Schroeder
*Assistant Examiner*—Mary A. Ellis

[57] ABSTRACT

A running sole for a shoe comprising a sole body 1, having a generally longitudinally extending first recess 5 extending from the one edge of the sole and at least one laterally extending second recess 6, 7, extending from the side edges of the sole in the heel region, said at least one second recess intersecting the first recess, a first supporting body 10 of springably compressible and/or flexible supporting material exchangeably inserted in said first recess and having at least one opening 11 inside thereof aligned with the second recess 6, 7, and at least one second similar supporting body 16, 17 inserted in said second recess(s) 6, 7 and engaging in said opening or openings to lock said supporting bodies in position.

13 Claims, 5 Drawing Figures

FIG. 1
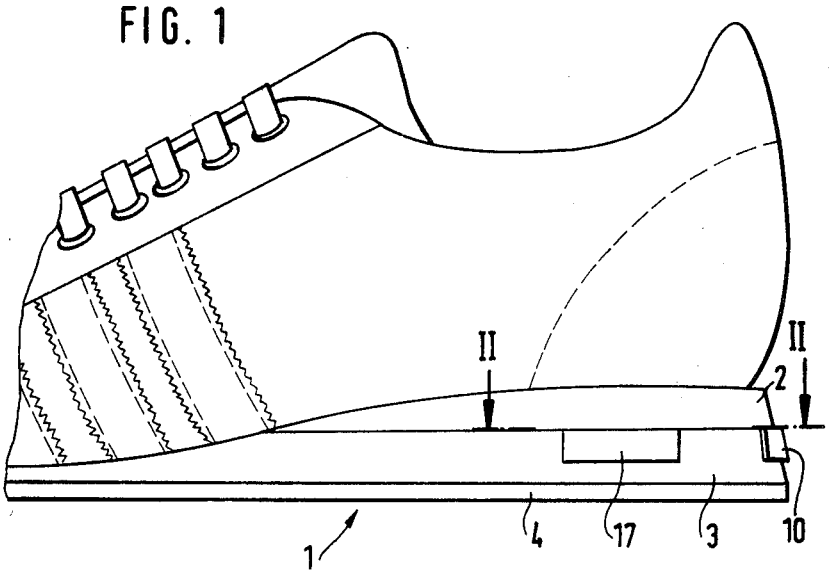
FIG. 2
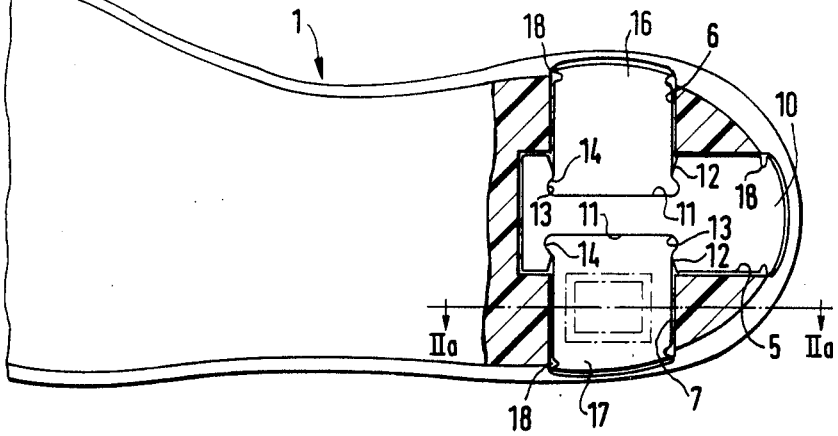
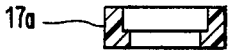
FIG. 2a

RUNNING SOLE FOR SHOES, ESPECIALLY SPORTS SHOES, WITH ADJUSTABLE HEEL CUSHIONING

The invention relates to a running sole for shoes, especially for sports shoes, having soft resilient plastic in the heel region.

In a known sports shoe sole of this type, for example as shown in U.S. Pat. No. 4,430,810, there are provided in the sole body, under the surface contacted by the heel, several recesses which extend transversely to the longitudinal direction of the sole and into which supporting bodies can be pushed from the lateral sole edge. The running sole consists of a relatively softly resilient plastic material and, without additional stiffening by means of the supporting bodies, is intended only for lightweight runners. However, the hardness and consequently the cushioning capacity of the running sole in the heel region can be varied by the choice of supporting bodies which are hard and/or resistant to bending to different degrees, so that it is possible to adapt it to meet the individual requirements of runners of any weight.

To guarantee that the supporting bodies are retained in their associated recesses even under the bending and compression stress on the sole which occurs during use, the recesses are open at both sole edges, and the supporting bodies have at their two ends flanges or the like, which can abut on the sole edge, to prevent the support bodies from being pushed out in either direction. Alternatively, the supporting bodies can each consist of two parts which can be pushed into the associated recess from sole edges located opposite one another and which can be connected positively and/or non-positively to one another in the interior of the opening. However, a continuous design of the openings is really only practical when the recesses extend transversely to the longitudinal direction of the sole, since otherwise a recess extending in the longitudinal direction of the sole would have to pass along the entire sole length. However, difficulties arise, here, when adjustable heel cushioning is also to be effected near to the rear edge of the sole and at which the foot begins to make contact, because, as a result of the rounding of the sole normally present at the rear, transverse recesses are relatively short there, and correspondingly short supporting bodies inserted in them, make them sufficiently effective only as a result of a compressibility of their material, but not because of the flexibility.

The primary object of the invention is, therefore, to design a running sole of the type described, in such a way that the supporting bodies can also produce their supporting effect near to the sole edge located on the same side as the heel.

According to the present invention, there is provided a running sole for a shoe, said sole comprising a sole body of softly resilient material in the heel region, said body having a longitudinal axis, an upper surface of said body located below the heel of the wearer and a lower surface of the body, a rear edge and two side edges of the body joined by said rear edge, a first generally longitudinally extending recess formed in the body, below the upper surface and above the lower surface and opening at one edge thereof, at least one generally transversely extending second recess in the body below the upper surface and above the lower surface and opening into at least one of said two side edges, said at least one second recess intersecting said first recess, a first springably compressible and/or flexible supporting body exchangeably insertable into said first recess and having a cross-section largely filling the cross-section of said first recess, a second springably compressible and/or flexible supporting body exchangeably insertable into the or each second recess, and having a cross-section largely filling the cross-section of said second recess, at least one opening in one of said first and second supporting bodies and a portion of said second supporting body or a portion of said first supporting body engageable in the or each opening in said first or second supporting body respectively.

With such a construction, two recesses are therefore provided, the axes of which run at an angle of, for example, 90° and which meet in the sole body under the surface contacted by the heel. The first recess which extends generally in the longitudinal direction of the sole can start from the rear edge of the sole, whilst the or each second recess extending transversely to the longitudinal direction of the sole is open towards the lateral sole edge. The first supporting body can have a sufficient length to ensure that not only its elastic compressibility but also its flexibility is put into effect for controlling the cushioning capacity of the sole. However, since the first recess has a blind end for obvious reasons, it is necessary to ensure that the supporting body inserted in it can not be pushed out during use. This is achieved by the second supporting body or bodies being pushed in from the side edge of the sole edge via the associated second recess(es) into the opening(s) of the first supporting body. Alternatively the first supporting body may be engaged in an opening provided in the second supporting body. Preferably, the inserted supporting body is locked in the opening in the other body so that the two supporting bodies are interlocked and prevent one another from slipping out. A particularly effective interlock is obtained when at least one of the openings in the first supporting body passes transversely through the supporting body and is aligned with a lateral recess passing completely through the sole width, and a rod-shaped second supporting body, for example, according to U.S. Pat. No. 4,430,810, can be pushed into the second recess and through the opening which extends right through the first supporting body. This rod-shaped supporting body can be provided with flanges at its two ends on the sole edge for engaging positively and/or non-positively in the recess, so that it is secured against being pushed out even under the squeezing stress on the sole. Moreover, the continuous opening provided in the first supporting body does not have to be surrounded completely by the supporting body, but can also form in its topside or underside a groove through which the second supporting body extends.

The first recess and correspondingly, the first supporting body can be arranged symmetrically relative to the heel vertex line and the sole centre line. However, it may be expedient to incline this recess at an acute angle to the sole centre line, so that the mouth of the recess at the sole edge is offset outwards. Consequently, the first supporting body is located with its rear end in the region of the point where the heel makes contact, and the rolling-off action can approximately follow the path of this supporting body. According to this angular offset, the second recess or recesses and associated supporting bodies can also be arranged offset or pivoted the same amount and in the same direction, so that pronation and the subsequent anti-pronation during the rolling-off action can be taken into account as a result.

Furthermore, the first recess and the first supporting body arranged in it can also be curved or arcuate, and for the reasons given above the arc starts from the sole centre line and runs towards the outside of the heel.

Advantageously, the recesses and consequently also the supporting bodies have a shallow rectangular cross-section, that is to say the supporting bodies are plate-shaped, so that a "platform" can be produced in the running sole under the surface contacted by the heel merely by means of two supporting bodies, and the resilience (flexibility and compressibility) of this platform can be varied according to requirements by means of an appropriate choice of hardness and/or resistance to bending of the supporting bodies. To prevent edges of the supporting body from becoming noticeable on the sole in an adverse way, the upper limiting surfaces of the recesses appropriately lie in a common plane. This is not absolutely necessary as regards the lower limiting surfaces; here, the cushioning behaviour of the sole can likewise be influenced by means of a different height of the recesses and consequently a different thickness of the supporting bodies.

In the design of the invention which is described later, the sole body has two recesses which extend at an angle to one another and which thus allow a correspondingly angular "platform" formed by the supporting bodies. Appropriately, the second recess is made in the outwardly directed half of the sole body, so that the cushioning capacity can be controlled in this region over which the rolling-off action of the foot from the heel takes place.

If, according to a further design, the inward-directed part of the running sole is also to be adjustable in terms of its cushioning capacity, then the transverse recess can open towards the two opposite side edges, and the supporting bodies are interlocked with one another because the first supporting body has, on its two opposite sides, an opening for locking the two second supporting bodies, or a continuous second supporting body has an opening in its rear side, so that the end of the first supporting body can be fastened in it.

In order that the invention will more readily be understood, the following description is given, merely by way of example, reference being made to the accompanying drawings, in which:

FIG. 1 is a partial side elevation of a sports shoe with one embodiment of running sole according to the invention;

FIG. 2 is a cross-section taken along the line II—II in FIG. 1;

FIG. 2*a* is a section on line IIa—IIa of FIG. 1; and

Figure 3:
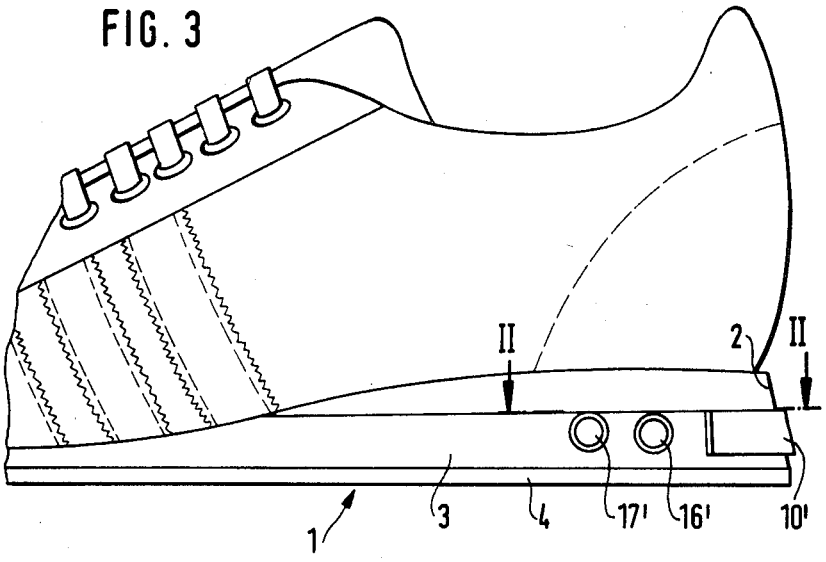
Figure 4:
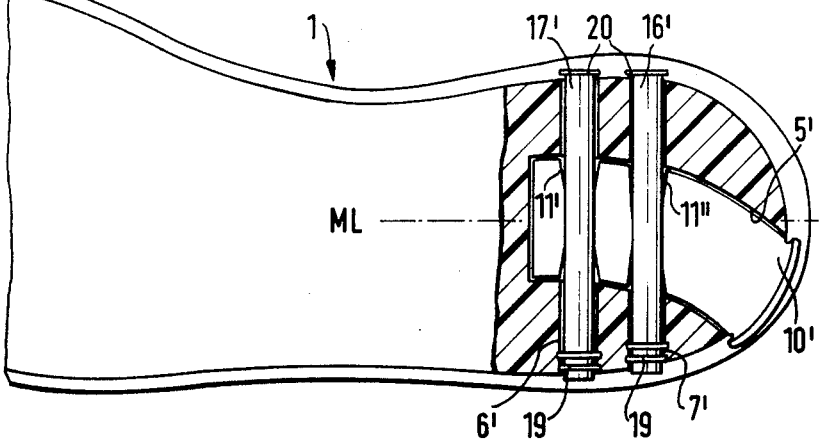

FIGS. 3 and 4 are a similar side elevation and section of a second embodiment of same.

The sports shoe illustrated in FIG. 1 has a running sole 1 which is composed of a heel wedge 2, an intermediate sole 3 and a profile sole 4 profiled in any form. The heel wedge 2 and the intermediate sole 3 consist of EVA, the heel wedge having a C-Shore hardness of 55 to 58 and the intermediate sole having a C-Shore hardness of approximately 45; the profile sole 4 consists of a wear-resistant rubber or the like. The individual sole parts are joined to one another by means of gluing or as a result of direct connection during the shaping operation.

As seen in FIG. 2, the intermediate sole 3 has, in the region under the wearer's heel a recess in the form of a groove 5 which opens into the rear edge of the sole and which has a shallow rectangular cross-section and is likewise rectangular in a horizontal projection (FIG. 2). The groove 5 extends beyond the point of the intermediate sole 3 which is located under the heel-bone curvature of the foot. Two transverse grooves 6 and 7 are formed in the intermediate sole 3 at an angle of 90° to groove 5, the groove 6 extending from the inner sole edge and the groove 7 from the outer sole edge into the opening 5, so that they intersect the latter. Since the transverse grooves 6 and 7 are aligned with one another and also correspond to one another in respect of their cross-sectional form, they could be considered as a single groove 7 which opens into the sole opposite edges and which intersects the longitudinal opening 5. In the embodiment illustrated, the cross-sectional forms of the grooves 5, 6 and 7 correspond to one another; their upper limiting surface lies in the same plane which is the lower limiting plane of the heel wedge 2.

Inserted into the longitudinal groove 5 is a supporting body 10 which fills this groove completely and the length of which is calculated so that at the rear edge of the sole it projects only slightly beyond this rear edge (see FIG. 1); the projecting length is, for example, only 2 to 3 mm. The supporting body 10 has openings 11 which are formed in its two side faces so as to correspond to one another, but are arranged symmetrically relative to its centre line, and which pass through the entire thickness of the supporting body 10 and are essentially rectangular. Starting from the side edge of the supporting body 10 the openings 11 taper somewhat, thus forming guiding surfaces 12, and following the guiding surfaces 12 they have re-entrant portions 13 which are located opposite one another and, as is evident from FIG. 2, are rounded. Inserted into the transverse grooves 6 and 7 are supporting bodies 16 and 17 respectively, which likewise fill the associated grooves completely and the inner ends of which have a form matching that of the openings 11 in the region of re-entrant portion 13 of the latter. Since both the supporting body 10 and the supporting bodies 16, 17 consist of an elastically resilient material, for example polyurethane, the end of the transverse supporting bodies 16, 17 can be pressed into the associated orifice 11, so that the lateral projections 14 formed at this end and located opposite one another snap elastically into the portion 13, and the supporting bodies 10, 16 and 17 are interlocked in this way. The length of the transverse supporting bodies 16, 17 is also arranged so that they project only a slight extent beyond the associated lateral sole edge. All the supporting bodies 10, 16 and 17 have, at the end adjacent to the sole edge, gripping notches 18 by means of which they can be grasped and pulled out by hand or by means of a tool. It goes without saying that it is possible to pull out the supporting body 10 only when the two transverse supporting bodies 16, 17 have previously been pulled out after the positive retention has been overcome as a result of elastic deformation.

The supporting bodies 10, 16 and 17 are available in different hardnesses and with different bending resistances, so that by a suitable choice of these supporting bodies it is possible to control the resilience of the "platform" formed by them when they are inserted. There are many possibilities of control, since each of these supporting bodies 10, 16 and 17 can have different properites. It may be expedient, in the embodiment illustrated, to make the supporting bodies 16, 17 essentially deformable under pressure, whilst the supporting body 10 extending in the longitudinal direction is mainly deformable due to a bending force and only allows a lower degree of deformation under pressure. It goes without saying that the deformability of the supporting bodies 16, 17 under pressure can vary from one to the other.

A pocket 17*a* is indicated by dot-and-dash lines in the supporting body 17, this pocket extending downwards from the upper surface of the supporting body, the pocket having an intermediate surface which surrounds a portion of reduced cross-section which extends to the bottom of the supporting body. A stiffening element having a form corresponding to that of the pocket can be inserted in this pocket, if required. It is thereby possible to vary the deformation property of the supporting body 17 per se, for example over its length. This can serve, for example, to keep the deformability of the supporting body under pressure lower near the sole edge than in the interior of the sole body.

The supporting bodies 10, 16 and 17 can be made with different hardnesses. A grading ranging from 65 to 85 C-Shore hardness, for example in three steps, is recommended.

In the embodiment of FIGS. 3 and 4, the design of the sports shoe per se remains unchanged, so that the same reference symbols are used for corresponding parts as in FIGS. 1 and 2. However, the embodiment illustrated here differs from that described previously in the type and design of the recesses corresponding to grooves 5, 6 or 17 and of the supporting bodies inserted therein.

As seen in FIG. 4, an arcuately curved groove 5', starting from the rear edge of the sole extends in the longitudinal direction of the sole, its outer mouth being offset towards the outside of the heel relative to the sole centre line ML which is marked by a dot-and-dash line and which coincides with the heel vertex line. Approximately transverse to the longitudinal direction of the sole, there are in the intermediate sole 3 two recesses 6', 7' of cylindrical cross-section, which are parallel to one another and which both intersect the groove 5' and extend across the entire sole width. Inserted into the longitudinal groove 5' is a correspondingly formed supporting body 10' of rectangular cross-section, which is provided with orifices 11', 11'' passing transversely through its width. In the inserted state, these orifices 11', 11'' are aligned with the transverse recesses 6', 7', so that cylindrical rod-shaped supporting bodies 16', 17' can be introduced from the lateral sole edge and pushed through the orifices 11', 11''. The rod-shaped supporting bodies 16', 17' completely fill the associated recesses 6', 7' and have annular ribs 19 and flanges 20 adjacent and at their ends. Consequently, they are retained securely both frictionally and positively—because the annular ribs 19 are pressed into the wall of the recesses—and at the same time lock the supporting body 10' in its recess 5'. As seen in FIG. 4, the orifices 11', 11'' likewise have, at each of their ends, widened portions which make it easier for the supporting bodies 16', 17', to be pushed in.

As regards the choice of material for the supporting bodies 10', 16' and 17', the same applies as was said previously in connection with the embodiment according to FIGS. 1 and 2. As distinct from the embodiment illustrated, the supporting body 10', like the associated opening 5', can be made straight and be arranged so that it forms with the sole centre line ML an acute angle of, for example, 10° to 15°. In this case, it is expedient, as explained in the introduction, also to "pivot" the supporting bodies 16', 17' in the same direction through the same angle and about the centre point of the surface contacted by the heel, so that they pass through the sole width obliquely. The same arrangement can also be provided directly in the embodiment according to FIGS. 1 and 2. In any case, it is essential merely that at least two supporting bodies should be arranged at an angle to one another in respect of their longitudinal extension, and that, in contrast to the design according to DE-OS No. 29 04 540 mentioned in the introduction, in which parts of one and the same supporting body can each be connected to one another, it should be possible to interlock them.

We claim:

1. A running sole for a shoe, said sole comprising a sole body of softly resilient material in the heel region, said body having a longitudinal axis, an upper surface of said body located below the heel of the wearer and a lower surface of the body, a rear edge and two side edges of the body joined by said rear edge, a first generally longitudinally extending recess formed in the body, below the upper surface and above the lower surface and opening at one edge thereof, at least one generally transversely extending second recess in the body below the upper surface and above the lower surface and opening into at least one of said two side edges, said at least one second recess intersecting said first recess, a first springably compressible and flexible supporting body exchangeably insertable into said first recess and having a cross-section largely filling the cross-section of said first recess, a second springably compressible and flexible supporting body exchangeably insertable into said at least one second recess, and having a cross-section largely filling the cross-section of said second recess, at least one opening in one of said first and second supporting bodies and a portion of the other of said first and second supporting bodies being engageable in said at least one opening in said one supporting body.

2. A running sole as claimed in claim 1, wherein said first recess opens into the rear edge of the sole.

3. A running sole as claimed in claim 1, wherein said second supporting body can be locked in the said at least one second recess.

4. A running sole as claimed in claim 1, wherein said at least one second recess passes transversely through the first supporting body, and wherein said at least one opening in said one supporting body passes completely therethrough, and wherein said second supporting body is rod-shaped and can be pushed through the said at least one second recess and through the said at least one opening in said one supporting body.

5. A running sole as claimed in claim 1, wherein said first recess is offset outwardly of the sole and runs at an acute angle to the longitudinal axis of the sole.

6. A running sole as claimed in claim 5, wherein said first recess is an arcuate recess.

7. A running sole as claimed in claim 1, wherein the first and second recesses have a shallow rectangular cross-section.

8. A running sole as claimed in claim 7, wherein the upper limiting surfaces of said first and second recesses lie in a common plane.

9. A running sole as claimed in claim 1, wherein there are two second recesses, aligned with one another and extending from the two opposite sides of said body, wherein there are two second supporting bodies, one in each of said two second recesses, and wherein there are two openings, one in each of the two opposite lateral sides of said first supporting body, into which are locked said two second supporting bodies.

10. A running sole as claimed in claim 1, wherein said at least one opening in said one supporting body is provided with a re-entrant portion and wherein said other supporting body is provided with a lateral bead lockingly engageable in said re-entrant portion.

11. A running sole as claimed in claim 1, wherein said at least one opening is provided with a tapered entry portion to facilitate the entry of the other supporting body.

12. A running sole as claimed in claim 1, and further comprising a pocket formed in at least one of said supporting bodies and a stiffening element exchangeably insertable in said pocket.

13. A running sole as claimed in claim 1, wherein said supporting bodies further comprise gripping notches at their ends adjacent the side or rear edge of the body into which they are inserted, to facilitate removal of the respective supporting body.

* * * * *